US010974739B2

(12) United States Patent
Cortesi

(10) Patent No.: US 10,974,739 B2
(45) Date of Patent: Apr. 13, 2021

(54) BOGIE FOR A RAIL VEHICLE, METHOD FOR COMPENSATING FOR CHANGES IN THE DIAMETER OF WHEELS ON RAIL VEHICLES, AND RAIL VEHICLE

(71) Applicant: STADLER RAIL AG, Bussnang (CH)

(72) Inventor: Alberto Cortesi, Gachnang (CH)

(73) Assignee: STADLER RAIL AG, Bussnang (CH)

( * ) Notice: Subject to any disclaimer, the term of this patent is extended or adjusted under 35 U.S.C. 154(b) by 382 days.

(21) Appl. No.: 16/070,870

(22) PCT Filed: Jan. 16, 2017

(86) PCT No.: PCT/EP2017/050809
§ 371 (c)(1),
(2) Date: Jul. 18, 2018

(87) PCT Pub. No.: WO2017/140449
PCT Pub. Date: Aug. 24, 2017

(65) Prior Publication Data

US 2019/0023288 A1 Jan. 24, 2019

(30) Foreign Application Priority Data

Feb. 17, 2016 (EP) ..... 16156045

(51) Int. Cl.
*B61F 5/10* (2006.01)
*B61F 5/50* (2006.01)
*B61F 5/52* (2006.01)

(52) U.S. Cl.
CPC ..... *B61F 5/10* (2013.01); *B61F 5/50* (2013.01); *B61F 5/52* (2013.01)

(58) Field of Classification Search
CPC ..... B61F 5/10; B61F 5/01; B61F 5/04; B61F 5/00; B61F 5/26; B61F 5/50; B61F 5/52; B61F 5/02; B61F 5/122
See application file for complete search history.

(56) References Cited

U.S. PATENT DOCUMENTS 3,586,306 A * 6/1971 Reece ..... B61F 5/50 267/3
5,195,438 A * 3/1993 Dumoulin ..... B61F 5/14 105/199.3

(Continued)

FOREIGN PATENT DOCUMENTS

EP 2 487 087 A2 8/2012
EP 2487087 A2 * 8/2012 ..... B61F 5/14
WO 99/17975 A1 4/1999

OTHER PUBLICATIONS

European Search Report Corresponding to 16156045.3 dated Aug. 18, 2016.

(Continued)

*Primary Examiner* — Jason C Smith
(74) *Attorney, Agent, or Firm* — Davis & Bujold, P.L.L.C.; Michael J. Bujold

(57) ABSTRACT

A bogie (100) for a rail vehicle. The bogie (100) comprises a frame (10) that is mounted on one or more wheel axles (20). The bogie (100) comprises at least one support surface for a vehicle body (40). At least one liftable surface on the bogie (100) is designed in such a way that its vertical distance, from the support surface, can be modified by a lifting element (50).

22 Claims, 4 Drawing Sheets

(56) References Cited

U.S. PATENT DOCUMENTS

Figure 1:
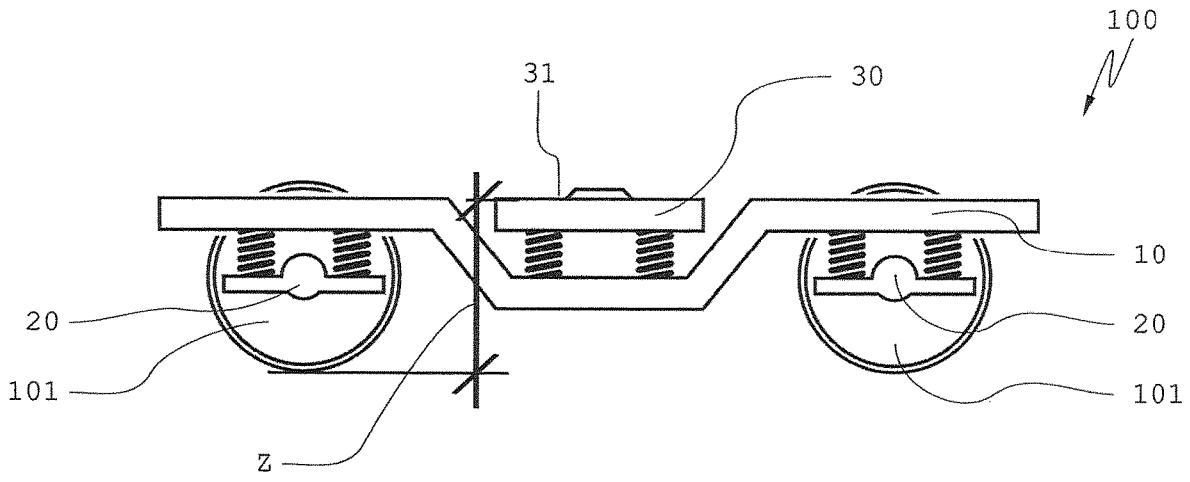

| | | | | |
|---|---|---|---|---|
| 5,638,757 | A * | 6/1997 | Cortesi | B61F 5/44 105/168 |
| 2019/0023288 | A1* | 1/2019 | Cortesi | B61F 5/50 |
| 2019/0118839 | A1* | 4/2019 | Chen | B61F 5/06 |
| 2020/0108844 | A1* | 4/2020 | Narita | B61F 5/52 |

OTHER PUBLICATIONS

International Search Report Corresponding to PCT/EP2017/050809 dated Apr. 19, 2017.
Written Opinion Corresponding to PCT/EP2017/050809 dated Apr. 19, 2017.

* cited by examiner

BOGIE FOR A RAIL VEHICLE, METHOD FOR COMPENSATING FOR CHANGES IN THE DIAMETER OF WHEELS ON RAIL VEHICLES, AND RAIL VEHICLE

The present invention relates to a bogie for a rail vehicle, a method for compensating for changes in diameter of wheels of rail vehicles, and a rail vehicle comprising a corresponding device according to the preambles of the independent claims.

Rail vehicles typically have wheels made of metal, which run on rails made of metal. During the course of use, the wheels are worn down. This means that they sustain wear. The wheels will therefore be lathed after a relatively long operating period. The lathing of the wheels involves a change in the diameter of the wheels. The wheels are typically mounted on axle shafts, which are secured resiliently to a frame, which is in turn resiliently connected to a vehicle body of the rail vehicle. Thus, any change to the diameter of the wheels means that the embarking edges of the vehicle bodies have a difference from a defined height, for example a station platform, following the lathing of the wheels. This difference has to be corrected.

Various devices and methods for compensating for this difference in height are known from the prior art. The rail vehicles are typically brought into large parking areas of maintenance workshops, wherein the complete rail vehicles are raised at their vehicle bodies in order to relieve the load of the bogies arranged beneath. The fastenings of the bogies are then released, such that a spacer element can be inserted at an interface between bogie and vehicle body. The bogies are then screwed in place again, and the rail vehicles are placed back on the rails. Due to the insertion of spacer elements, the embarking edges of the vehicle bodies are distanced further from the wheel axle accordingly, such that the original height of the embarking edges is re-established, even if the wheels are worn.

Document U.S. Pat. No. 3,586,306 discloses a device which has a rotatable spacer plate in the region of a spring suspension, which spacer plate can be rotated in two or more positions. Here, it is proposed to raise the vehicle body with the aid of a jack, such that there is a spacing, that is to say an interface, created between two adjacent parts. The spacer plate already placed beforehand within this spacing can thus be rotated. The rotation makes it possible to support a first part of the spacer plate on a second part of the spacer plate with different axial spacings. A permanent increase of the spacing between wheel axle and embarking edge of a rail vehicle is thus made possible.

The known devices and methods from the prior art have different disadvantages. On the one hand, either very large workshops or repair halls have to be made available, or the adjustment of the spacer plates requires additional devices or tooling.

The object of the invention is to overcome these and further disadvantages of the prior art. In particular, a device and a method are to be provided which make it possible to compensate for changes in diameter at wheels of rail vehicles in a simple way.

This object is achieved by the devices and methods defined in the dependent claims. Further embodiments will become clear from the dependent claims.

A bogie according to the invention for a rail vehicle comprises a frame which is mounted on one or more wheel axles. The bogie comprises at least one supporting surface for a vehicle body. At least one lifting surface is formed on the bogie and is formed such that its vertical spacing from the supporting surface is changeable by a lifting element, such that a spacer element insertable into the vertical spacing. Additionally or alternatively, the vertical spacing is fastenable by means of the lifting element.

A supporting surface of the bogie can be arranged for example on a crossmember of the bogie. An arrangement on a plate above an air suspension is likewise conceivable.

The lifting surface of the lifting element has a vertical spacing from the supporting surface, at least in a raised state. Here, it is conceivable that the lifting surface and supporting surface are horizontally distanced and/or are arranged on different elements of the bogie.

The spacer element is insertable into the vertical distance for a permanent increase of the distance between wheel axle and embarking edge.

A lifting element with a lifting surface on the bogie makes it possible to manufacture the lifting element as an integral part of the bogie. There is thus no need for any additional devices in order to increase the vertical spacing. Here, it is conceivable to manufacture the spacer element, which can be inserted into the vertical spacing, likewise as an integral part of the bogie. For example, it is thus conceivable to manufacture the spacer element as a toothed rack with non-return mechanism. An adjustable set screw which can be fixed in a preferred position is also conceivable. In particular, it is also conceivable, however, to provide spacer elements which can be rotated relative to one another such that they have different thicknesses as a result of the rotation.

The lifting element is preferably arranged integrally at the bogie. The lifting element is thus formed as part of the bogie and/or is it least permanently secured thereto.

All of the devices and/or mechanisms for increasing the vertical spacing between lifting surface and supporting surface are thus arranged at the bogie. This makes it possible to dispense with costly and complex workshops and/or workshop equipment.

The lifting element preferably is actuatable hydraulically or pneumatically.

Rail vehicles typically have equipment and/or circuits which are actuated pneumatically and sometimes also hydraulically. It is thus possible to actuate the lifting element independently of external devices or drives.

An embodiment of this kind, however, does not limit the actuation of the lifting element to the autonomy of a rail vehicle.

External drives or external provision of pneumatics or hydraulics is possible.

The bogie preferably has a crossmember which has at least one bore hole for receiving the lifting element movably, such that the bore hole and the lifting element form a space which is fillable with a fluid.

A space-saving integration of the lifting element in the bogie is thus made possible.

The bore hole preferably comprises a fluid feed channel, which preferably has a coupling element for connection of a fluid source, in particular compressed air or hydraulic oil.

This makes it possible to couple and uncouple the fluid source, such that the lifting element is decoupled for example in the case of normal operation of the rail vehicle. Incorrect handling of the lifting element is thus made impossible.

The bore hole and/or the lifting element can have at least one sealing element.

It is thus ensured that an appropriate build-up of pressure is possible within the bore hole. In addition, the infiltration of dirt or impurities is prevented.

The sealing element is preferably arranged in such a way that a sealing effect is attainable only up to a defined lifting height of the lifting element.

This ensures that the lifting element is moved only to a certain extent. A displacement of the lifting element beyond the sealing element means that the combination of bore hole and lifting element is not tight, and pressure drops. A further displacement of the lifting element is thus made impossible.

A return mechanism can be provided on the lifting element, which return mechanism is preferably formed as a return spring for returning the lifting element.

A lifting surface of the lifting element is preferably operatively connected to a vehicle body or a counterpiece of an interface. Once the vehicle body has been raised and once the spacer element has been inserted, the lifting element however is to be moved back in the direction of the starting position in order to avoid falsely introduced forces. Moving the lifting element back can be advantageous additionally with regard to the protection against infiltration of dirt or moisture.

This is made possible by a return mechanism as described in the present case. Alternatively, the weight of the bearing vehicle body can be used as a return force following insertion of the spacer piece.

The bogie can comprise one or more, preferably two centering pins for centering a vehicle body on the bogie, which centering pins are formed as lifting elements. A surface of the centering pin can be formed as a lifting surface.

The lifting element can thus take on a second function. In particular, it is thus possible to form existing centering pins on the bogie as lifting elements and to thus provide these with a second function. This makes it possible to dispense with further additional parts for adjusting the vertical spacing.

It is also conceivable for one or more air springs of an air suspension to be formed as lifting elements between the frame and the supporting surface of the bogie. At least one first air spring, preferably two first air springs, is/are associated in each case with a lifting surface, and a second air spring, preferably two air springs, is/are associated in each case with a supporting surface. The first air spring or the first air springs are arrangeable beneath a first vehicle body, and the second air spring or the second air springs are arrangeable beneath a second vehicle body.

This enables the use of existing air spring elements as lifting elements. An adjustment of the vertical spacing between a lifting surface and a supporting surface of a first vehicle body is made possible by the raising of a second vehicle body. Here, the vehicle bodies are connected to one another.

The first air springs and the second air springs are in each case assigned to a group of air springs. Shut-off means for separating the groups of air springs from one another are preferably provided between the individual groups of air springs of an air suspension.

This enables the automatic and independent actuation of the individual groups and/or of individual air springs.

A vehicle body can thus be raised independently of another vehicle body.

This is advantageous in particular in the case of rail vehicle configurations comprising what are known as Jacobs bogies, which in each case support two adjacent vehicle body ends. Adjacent vehicle body ends are typically connected to one another by means of a coupling.

The raising of a vehicle body by means of the associated air spring group allows the simultaneous raising of the adjacent second vehicle body end connected to the first vehicle body. Here, merely the air springs beneath the first vehicle body are acted on with pressure, and the air springs beneath the second vehicle body have a lower pressure than the air springs beneath the first vehicle body. The air springs beneath the second vehicle body are preferably pressureless. The second vehicle body can thus be distanced using spacer elements.

The air springs can preferably be acted on with pressure via a compressed air system already provided on the rail vehicle for operation of the air suspension.

The air suspension preferably comprises a coupling element for connection to an external compressed air source. The individual groups of air springs preferably comprise separate coupling elements.

The bogie can be formed as a Jacobs bogie.

An uncomplicated and simple increase of the vertical spacing at rail vehicles with Jacobs bogie is thus made possible.

A spacer element of the bogie can be constructed in a number of parts and it can have a variable thickness. The thickness is preferably adjustable by rotating individual elements of the spacer element relative to one another.

This makes it possible to arrange the spacer element in a first position, and therefore with a first thickness, on the bogie. Additional components for increasing the vertical spacing are thus superfluous.

A further aspect of the invention relates to a method for compensating for changes in diameter of wheels of rail vehicles, preferably with a bogie as described above. A spacer element is inserted into a vertical spacing between a lifting surface and a supporting surface, wherein the vertical spacing of the lifting surface from the supporting surface is changed using a lifting element and in particular is enlarged, wherein the lifting element is comprised by the bogie. The spacer element is inserted in order to permanently distance the lifting surface from the supporting surface, in such a way that a height between the wheel axle and an embarking edge of the rail vehicle is permanently enlarged.

As a result, after having enlarged the spacing, there is no need for any further measures, in particular it is not necessary to remove again a lifting element, which for example was additionally attached, in order to bring the bogie into an operating state.

The spacing is preferably changed using an integral lifting element arranged on the bogie. The advantages of an element formed/arranged integrally on the bogie are mentioned herein.

The lifting element can be received in a bore hole and together therewith can form a cavity, wherein this cavity is applied pressure to by a fluid and in particular compressed air or hydraulic oil, such that the lifting element is moved under pressure and therefore the vertical spacing between the lifting surface and the supporting surface is changed.

A simple change to the vertical spacing is thus made possible.

In order to maintain a greater spacing between the supporting surface and the wheel axle of the bogie, a spacer element is preferably set to a desired thickness.

This enables the use of a spacer element which is already formed as part of the bogie prior to the enlargement of the spacing.

The thickness of the spacer element is preferably adjusted by rotating individual elements of the spacer element relative to one another.

The spacer element can thus be fabricated from a number of elements complementary to one another.

Once the vertical spacing has been enlarged, the lifting element can be made pressureless, in particular by draining or relieving the pressure of the fluid. The lifting element is preferably brought back into a starting position by means of a return element.

All elements can thus be brought back into their starting position. An unintentional introduction of forces and/or an impairment of the function as a result of ambient influences, such as dirt or water, is thus prevented.

A further aspect of the invention relates to a rail vehicle comprising a bogie as described herein, preferably comprising in particular a vehicle body. The pre-assembly and thus synchronisation of all components with one another, in particular of the lifting element and of the entire rail vehicle, is thus made possible.

A further aspect of the device relates to a rail vehicle comprising a vehicle body and a bogie as described herein. Here, the lifting element is arranged integrally at the vehicle body. The vehicle body preferably comprises a bore hole for receiving the lifting element movably, such that the bore hole and the lifting element form a space that is fillable with a fluid.

This enables the integral manufacture of the lifting element on the vehicle body, regardless of the design of the associated bogie.

Figure 2:
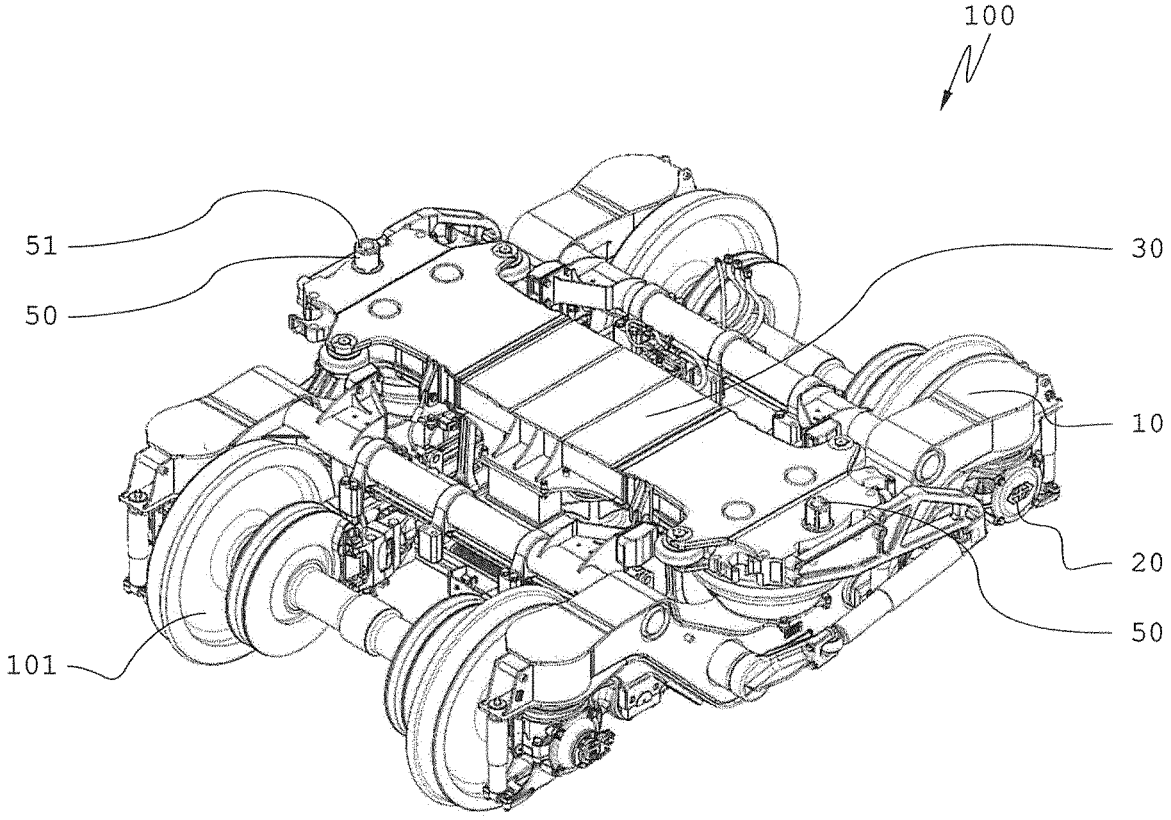
Figures 3A, 3B:
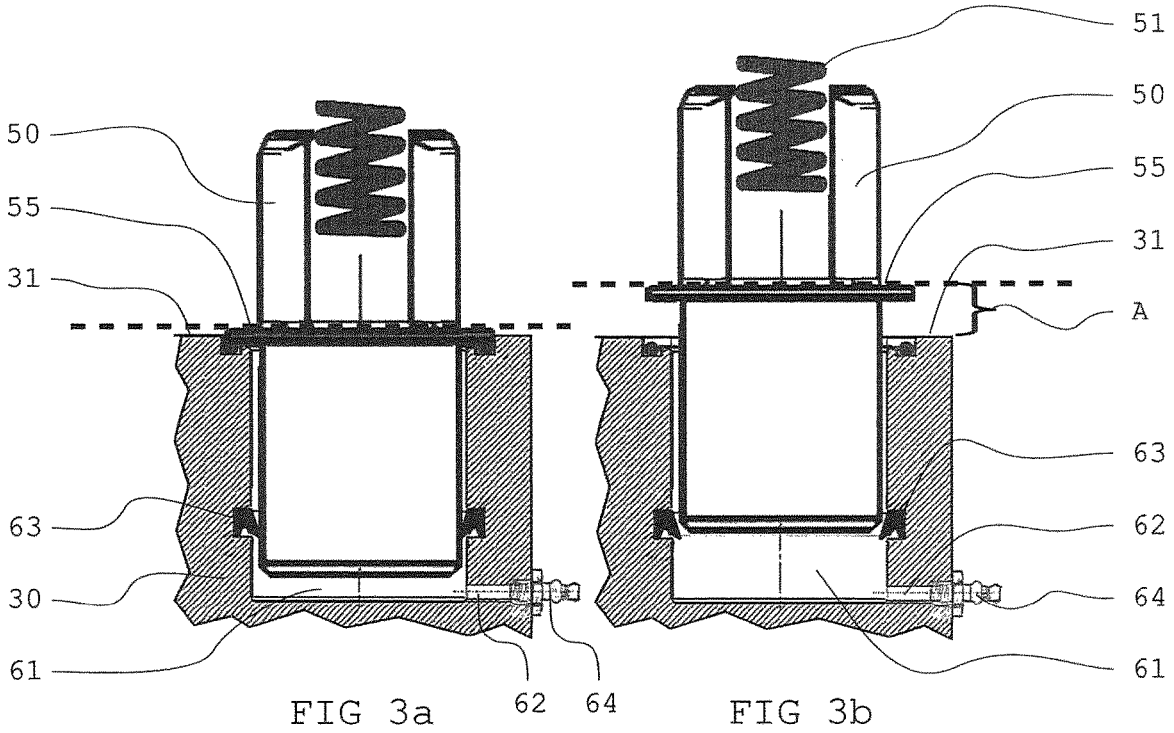
Figure 4:
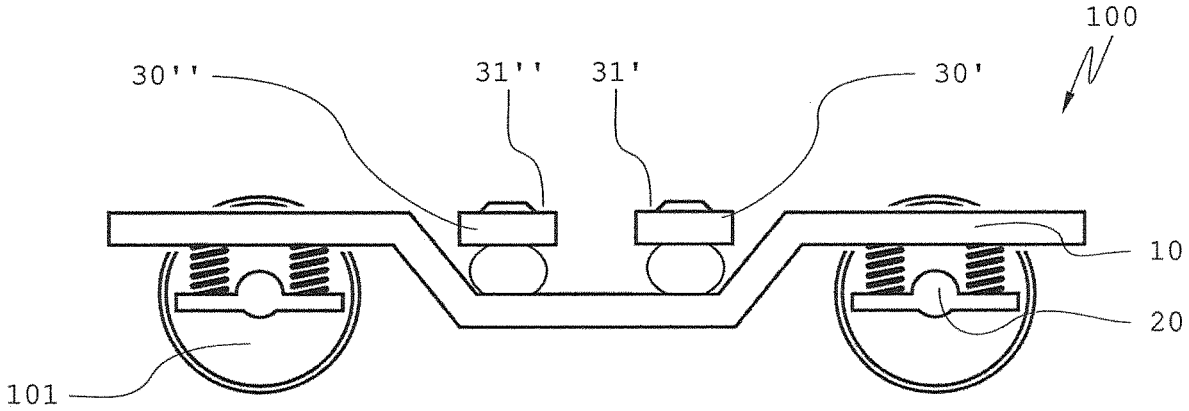
Figure 5:
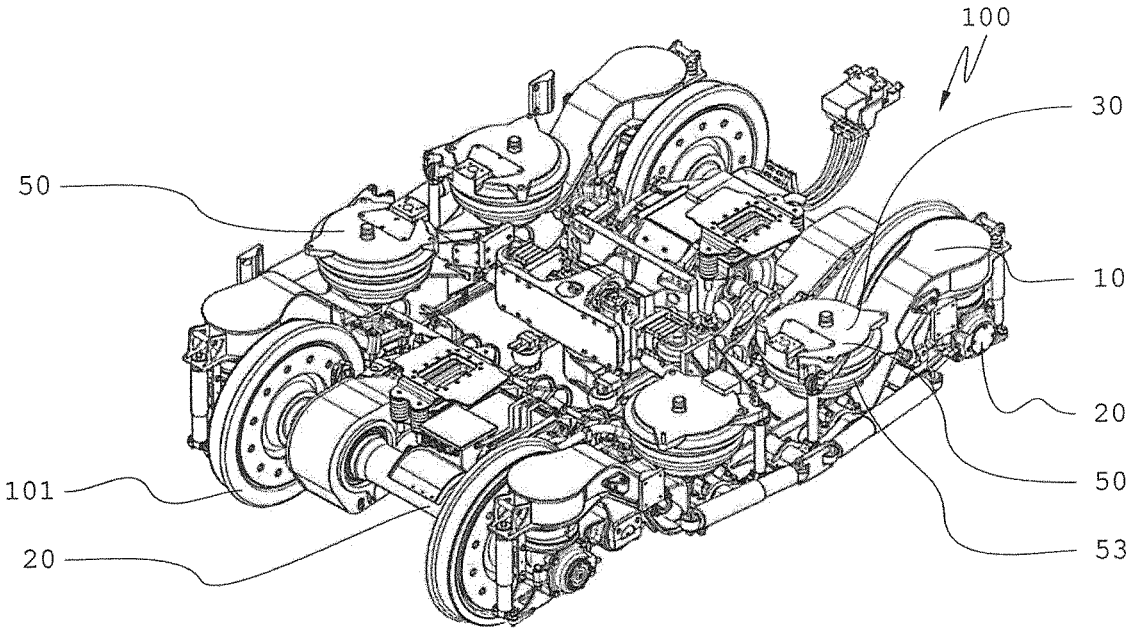
Figure 6:
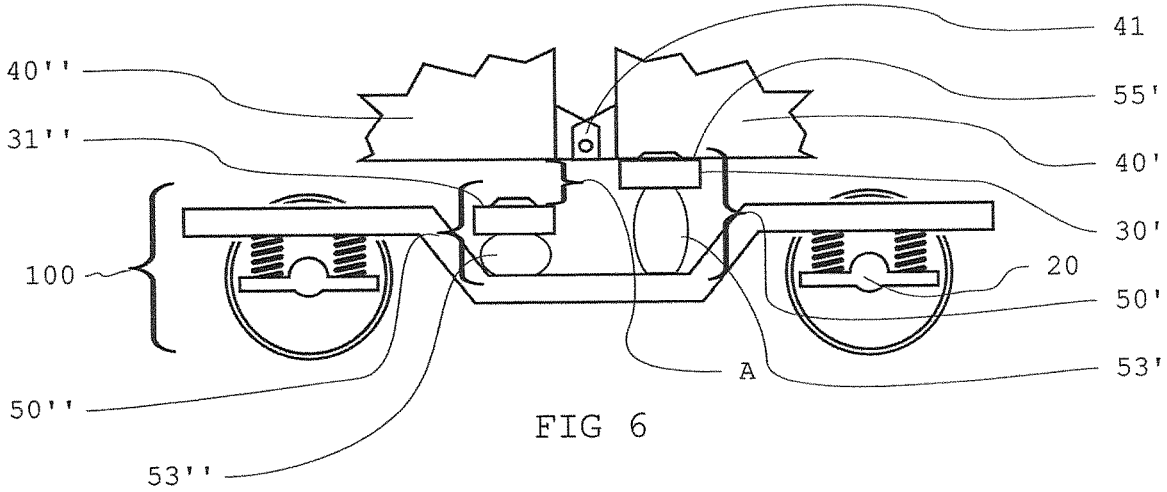
Figure 7:
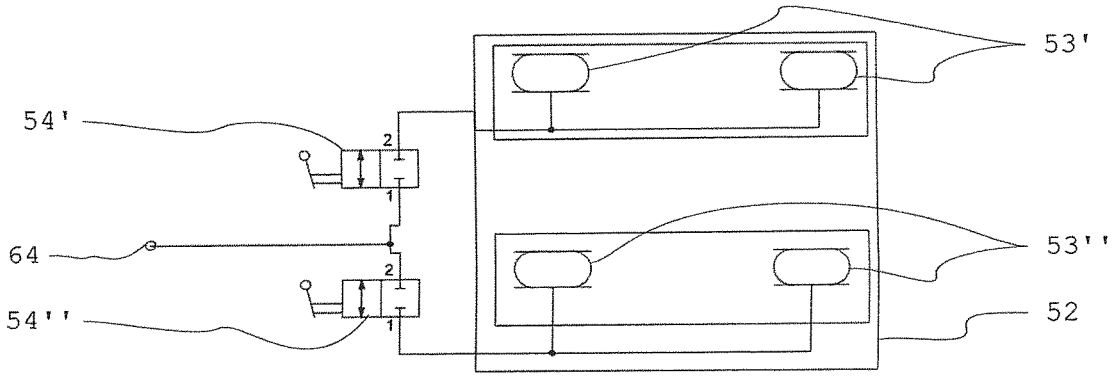
Figure 8:
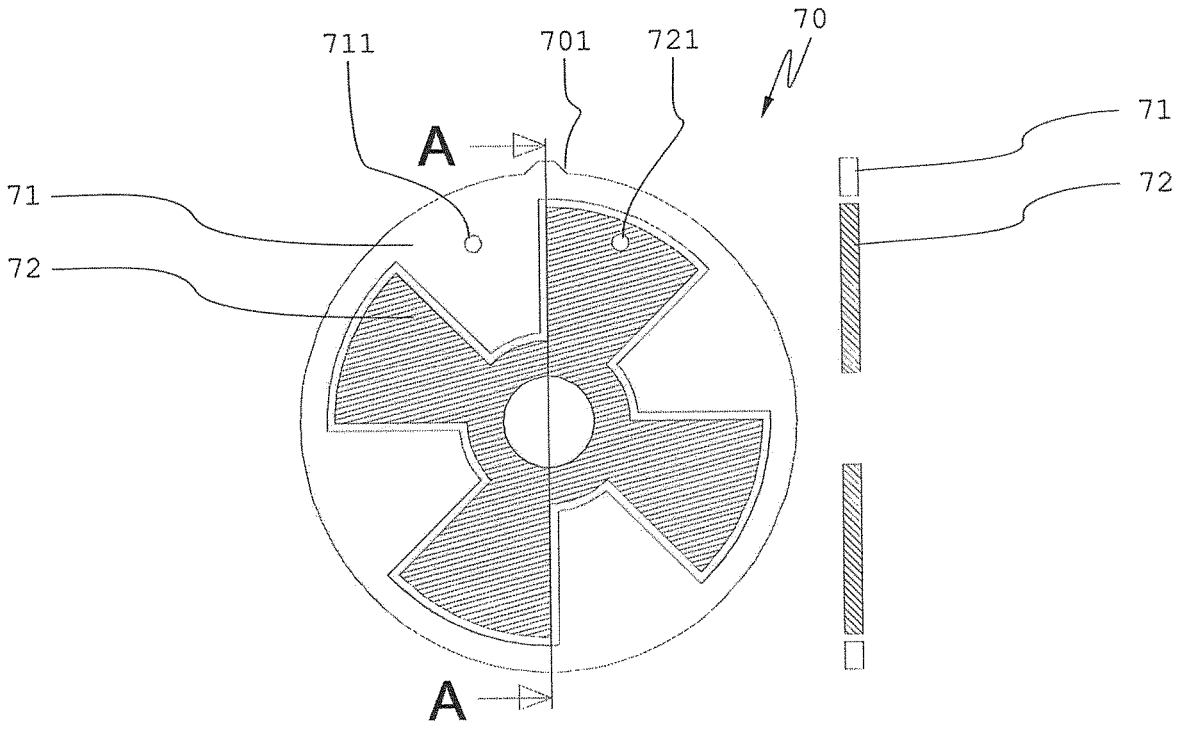
Figure 9:
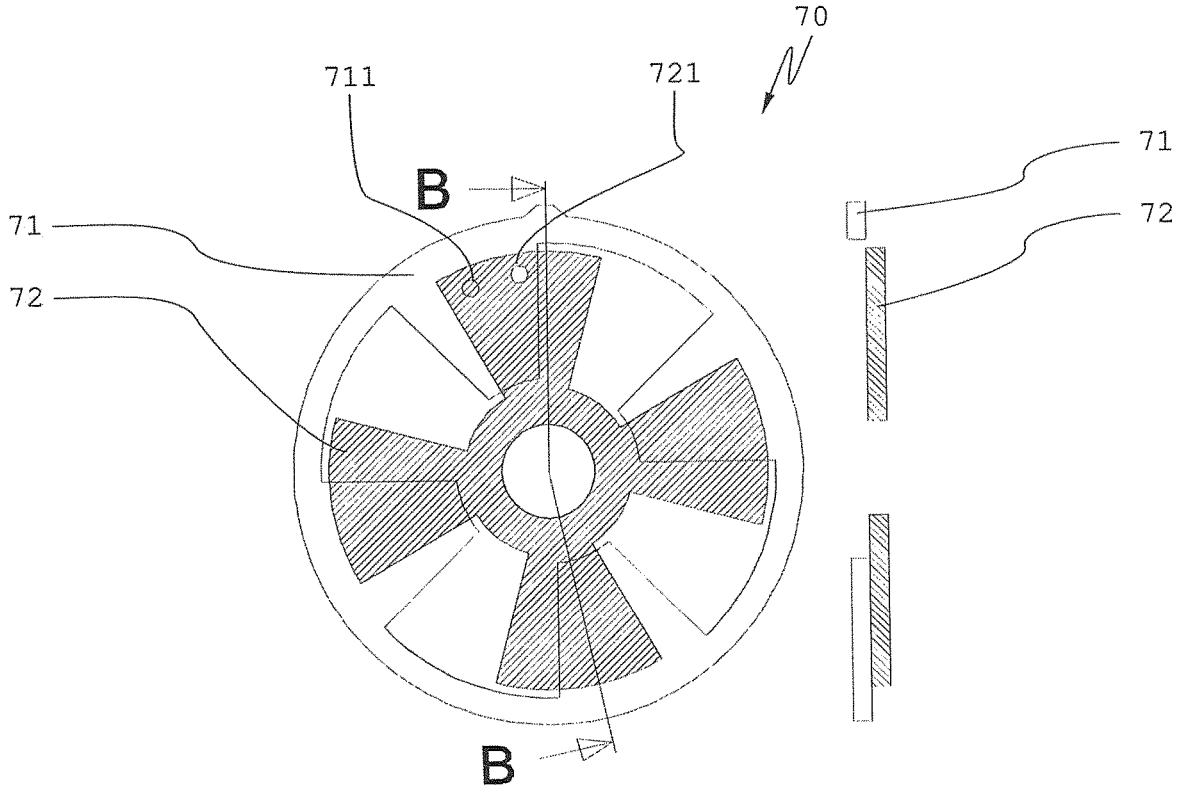

A plurality of exemplary embodiments of the present invention will be described on the basis of drawings, in which:

FIG. 1: shows a schematic depiction of a bogie;

FIG. 2: shows a perspective view of a bogie according to the invention;

FIGS. 3*a* and 3*b*: show a schematic detailed view of a lifting element;

FIG. 4: shows a schematic depiction of a second embodiment of a bogie according to the invention;

FIG. 5: shows a perspective view of a bogie according to the invention according to FIG. 4;

FIG. 6: shows a schematic depiction of the operating principle of the bogie according to the invention according to FIG. 4;

FIG. 7: shows a pneumatic schema associated with the bogie from FIG. 5;

FIG. 8: shows a spacer element in the original position;

FIG. 9: shows a spacer element during the adjustment process.

FIG. 1 shows a schematic depiction of a conventional bogie 100 for rail vehicles. The bogie 100 has two axles 20, on which there are arranged wheels 101. The axles 20 are fitted on a frame 10, wherein a suspension (not denoted in greater detail) is provided between the axles and frame 10. The bogie 100 comprises a crossmember as support element 30. The support element 30 is connected to the frame 10 via a suspension (likewise not denoted in greater detail). The suspension for example can be an air suspension or another alternative suspension. In the present case, conventional steel springs are shown. The support element 30, in its upper region, has a supporting surface 31. The supporting surface 31 is distanced from the lower edge of the wheels 101, and therefore from the rail upper edge SOK, by the spacing Z. As can be clearly seen from FIG. 1, the spacing Z reduces when the diameter of the wheels 101 becomes smaller, for example as a result of wear or as a result of lathing of the wheels. The supporting surface 31 correlates in the factory-made state for example to an embarking edge of the station platform. If the wheels 101 are lathed, i.e. reduced in their diameter, a desired dimension between the supporting surface 31 and the station platform thus changes. This has to be corrected.

FIG. 2 shows a perspective depiction of the bogie 100 from FIG. 1. In order to provide an improved overview, only individual elements of a group of identical elements are provided with a reference sign.

The bogie 100 has four wheels 101, which are arranged in pairs on each wheel axle 20. The wheel axles 20 are arranged on a frame 10, on which there is in turn arranged a support element 30 as crossmember. The support element 30 is connected here to the frame 10 by means of resilient elements (not denoted here in greater detail), and said frame is connected to the wheel axles again by means of resilient elements. The support element comprises a lifting element 50 on each side, which lifting elements in the present case are additionally designed to centre a vehicle body arranged on the bogie 100. The lifting elements 50 each comprise a return mechanism 51. The function and design of the elements 50 will be described in FIG. 3 hereinafter.

FIGS. 3*a* and 3*b* show a schematic depiction of the lifting elements in a number of operating states. FIG. 3*a* shows a lifting element 50 in a starting position. The lifting element 50 is formed as a cylindrical journal which has a collar in the region of reference sign 55. The collar, on its upper side, has a lifting surface 55. The lifting element 50 is disposed in a bore hole 61 of the support element 30. A seal 63 is arranged in the bore hole and seals a cavity beneath the lifting element 50. This cavity is connected to the external area by means of a fluid feed channel 62 via a coupling element 64, in the present case a connection nipple. A fluid can be introduced into the cavity of the bore hole 61 via the coupling element 64. This fluid pushes the lifting element 50 upwardly (see FIG. 3*b*). If the lower edge of the lifting element 50 reaches the seal 63, the sealing function between the seal 62 and the lifting element 50 is interrupted. The fluid pumped in via the coupling element 64 can escape via an annular gap around the cylindrical lifting element 50. Further movement of the lifting element 50 upwardly is therefore no longer possible.

In FIG. 3*a* the lifting element 50 is shown in the first operational state, i.e. in the factory-made state. The dashed line at the surface 55, which correlates with the lifting surface 55, can be the underside of a vehicle body, for example.

As shown in FIG. 3*b*, fluid can be introduced into the bore hole 61 via the coupling element 64. The lifting element 50 and in particular the lifting surface 55 moves upwardly, and a vertical spacing A is created between the lifting surface 55 and in particular between an underside of the vehicle body (dashed line) and a supporting surface 31. A spacer element can now be inserted in this spacing A. The spacing A is permanently increased by insertion of a spacer element. With reference to FIG. 1, it can thus be seen that a spacer element on the supporting surface 31 increases the spacing between the new supporting surface 31, i.e. the upper edge of the spacer element, and the wheel axle. The original spacing Z is re-established.

FIG. 4 shows a schematic depiction of a further embodiment of the bogie 100 according to the invention. Instead of conventional coil springs, air springs are provided between the support elements 30' and 30" and the frame 10. The bogie 100 from FIG. 4 is formed in the present case as a Jacobs bogie. A frame 10, on which two wheel axles 20 are resiliently arranged, wherein wheels 101 are arranged on each of the wheel axles 20, is likewise shown. Two support elements 30' and 30" with supporting surfaces 31' and 31" are likewise arranged on the frame 10 independently of one another. The support elements 30' and 30" are each connected to the frame 10 via independent springs.

FIG. 5 shows a perspective depiction of a bogie 100. For improved clarity, like elements of a group of elements are in each case provided with a reference sign just once. The bogie 100 has four wheels 101, which are each fastened in pairs to an axle 20. The axles 20 are fastened resiliently on a frame 10, on which there are in turn arranged four lifting elements 50. The lifting elements 50 are formed in the present case from an air spring 53 and a support element 30.

FIG. 6 shows a schematic depiction of the operating principle of the bogie 100 from FIGS. 4 and 5. Two vehicle bodies 40' and 40" are arranged on the bogie 100 and are connected to one another via a coupling 41. In order to increase a vertical spacing between a lifting surface 55' and a supporting surface 31", the lifting element, which is formed in the present case as an air suspension 50' (FIG. 5), is filled with air. Here, the air feed to the second air suspension 50" is interrupted. The second lifting element 50" therefore does not move. A vertical spacing A is created between the supporting surface 31" of the second lifting element 50" and the lifting surface 55' of the first lifting element. The vehicle bodies 40' and 40" are connected to one another by the coupling 41. A spacing A is created accordingly between the second lifting element 50", that is to say between the supporting surface 31" and an underside of the vehicle body 40'. A spacer element can be inserted in this spacing.

The pressure from the first lifting element 50' can then be drained again. The method is now repeated in the reverse sequence. The lifting element 50" is pumped up and a spacer element is inserted between the lifting element 50' and the vehicle body 40'. Both vehicle bodies 40', 40" are thus distanced from the wheel axle 20 by an enlarged vertical spacing.

FIG. 7 shows a pneumatic schema as can be used in the device and for carrying out the method from FIG. 6. What is shown is an air suspension 52 with two first air springs 53' and two second air springs 53". Shut-off means 54' and 54" are provided on the air suspension 52. The air feed arrives via the coupling element 64. Each of the first air springs 53' or the second air springs 53" can be added pressure to with compressed air by means of the shut-off means 54' and 54", wherein the other air springs can be made pressureless. What is shown is a 2/2-way valve. However, it is also conceivable to use a 3/2-way valve, such that the air springs 53' or 53" can each be emptied fully.

FIG. 8 shows a spacer element which can be used for a bogie as described herein. What is shown is a plan view and a sectional view. The spacer elements 70 consists of two parts 71 and 72. These are preferably manufactured from a single piece. The spacer element 70 is in the present case manufactured from a metal sheet 20 mm thick. Here, the second element 72 is lasered or burned out from the first element 71. Both elements can thus be used. The first and the second element 71, 72 have a bore hole 711, 721 respectively, which bore holes can be brought into alignment with one another by rotation (see FIG. 9). The individual elements 71 and 72 are laid one inside the other in the factory-made form (see sectional view), in such a way that the spacer has a thickness according to the sheet thickness, in the present case 20 mm. In this position, the spacer elements 70 can already be preassembled on the bogie. A lug 701 is shown on the first element 71. This lug can be used for example in order to hammer loose any rusted spacer elements 70.

FIG. 9 shows the spacer element 70 from FIG. 8 in a rotated position. In order to increase the thickness of the spacer element 70, the second element 72 is raised and rotated relative to the first element 71. As can be seen from the sectional view, the two elements then lie one on top of the other. The spacer element 70 consequently has a thickness corresponding to double the sheet thickness, in the present case 40 mm. In FIG. 9 the spacer elements 70, or rather the two individual elements 71 and 72, has not yet reached its end position. The individual elements 71 and 72 are preferably arranged in their end position in such a way that the bore holes 711 and 721 are congruent. Here, it is conceivable for example to place a journal in one of the bore holes 711 or 721, such that the individual elements 71 and 72 can no longer be rotated relative to one another.

Of course, it is conceivable to provide a plurality of striking lugs 701 and/or a plurality of positioning bore holes 711, 721 on the spacer element 70 from FIG. 8 or 9. It is also conceivable to form the spacer element 70 in a number of parts.

The invention claimed is:

1. A bogie for a rail vehicle comprising:

a frame which is mounted on one or more wheel axles, and at least one supporting surface for a vehicle body, wherein at least one lifting surface is formed, which is designed such that its vertical spacing to the supporting surface is changeable by a lifting element, such that a spacer element is insertable into the vertical spacing and/or the vertical spacing is fastenable by the lifting element, wherein a crossmember of the bogie has at least one bore hole for receiving the lifting element movably, such that the bore hole and the lifting element form a space which is fillable with a fluid.

2. The bogie according to claim 1, wherein the lifting element is integrally arranged at the bogie.

3. The bogie according to claim 1, wherein the lifting element is actuatable one of hydraulically or pneumatically.

4. The bogie according to claim 3, wherein the lifting element has at least one sealing element.

5. The bogie according to claim 4, wherein the sealing element is arranged in such a way that a sealing effect is attainable only up to a defined lifting height of the lifting element.

6. The bogie according to claim 1, wherein a return mechanism is arranged at the lifting element for returning the lifting element.

7. The bogie according to claim 1, wherein one centering pin, for centering a vehicle body on the bogie, is formed as a lifting element, and an upper surface of the centering pin is formed as the at least one lifting surface.

8. The bogie according to claim 1, wherein the spacer element is formed as a number of parts and with a variable thickness.

9. The bogie according to claim 8, wherein the thickness of the spacer element is adjustable by rotating individual elements of the spacer element relative to one another.

10. A rail vehicle having the bogie according to claim 1.

11. A method of compensating for changes in diameter of wheels of rail vehicles according to claim 10, the method comprising:

inserting a spacer element into a vertical spacing, between a lifting surface and a supporting surface, changing the vertical spacing, between the lifting surface and the supporting surface, using a lifting element, and the lifting element is comprised by the bogie.

12. The method according to claim 11, wherein the spacing is changed using a lifting element integrally arranged at the bogie.

13. The method according to claim 11, wherein a bore hole in which the lifting element is received and, together with said lifting element, forms a cavity in which pressure is applied to by a fluid, such that the lifting element is moved under pressure and therefore the vertical spacing of the lifting surface from the supporting surface is changed.

14. The method according to claim 11, wherein a spacer element is set to a desired thickness in order to maintain a larger spacing between the supporting surface and the wheel axle of the bogie.

15. The method according to claim 11, wherein once the vertical spacing is enlarged, the lifting element is made pressureless and the lifting element is brought back into a starting position.

16. A rail vehicle having a vehicle body and having a bogie according to claim 1, wherein the lifting element is arranged integrally with the vehicle body.

17. A rail vehicle according to claim 16, wherein the vehicle body has a bore hole for movably receiving the lifting element such that the bore hole and the lifting element form a space that is fillable with a fluid.

18. The bogie according to claim 1, wherein the bore hole has at least one sealing element.

19. The bogie according to claim 18, wherein the at last one sealing element is arranged in such a way that a sealing effect is attainable only up to a defined lifting height of the lifting element.

20. A bogie for a rail vehicle, comprising a frame which is mounted on one or more wheel axles, and at least one supporting surface for a vehicle body, wherein at least one lifting surface is formed, which is designed such that its vertical spacing to the supporting surface is changeable by a lifting element, such that a spacer element is insertable into the vertical spacing and/or the vertical spacing is fastenable by means of the lifting element, wherein one or more air springs of an air suspension is/are formed between the frame and the supporting surface as lifting elements, wherein at least one first air spring is associated with a lifting surface, and a second air spring is associated with a supporting surface, wherein the first air spring is arrangeable beneath a first vehicle body and the second air spring is arrangeable beneath a second vehicle body, wherein shut-off means for separating the groups of air springs from one another are provided and/or the air suspension comprises a coupling element for connection to a compressed air source, wherein the individual groups of the air springs comprise separate coupling elements.

21. The bogie according to claim 20, wherein the bogie is formed as a Jacobs bogie.

22. The bogie according to claim 20, wherein the thickness of the spacer element is adjustable by rotating individual elements of the spacer element relative to one another.

* * * * *